US005462386A

United States Patent [19]

Prescott

[11] Patent Number: 5,462,386

[45] Date of Patent: Oct. 31, 1995

[54] WATERTIGHT RAISING BAND FOR MANHOLE

[76] Inventor: Alain Prescott, 102 De Gaulle, Lorraine, Quebec, Canada, J6Z 3Z2

[21] Appl. No.: 299,967

[22] Filed: Sep. 2, 1994

[51] Int. Cl.[6] ..... E02D 29/14

[52] U.S. Cl. ..... 404/26

[58] Field of Search ..... 404/26, 25; 52/20

[56] References Cited

U.S. PATENT DOCUMENTS

| | | | |
|---|---|---|---|
| 1,959,171 | 5/1934 | Mayer . | |
| 2,593,918 | 4/1952 | Redman . | |
| 3,240,133 | 3/1966 | Ross . | |
| 3,331,295 | 7/1967 | Sorrell . | |
| 3,891,337 | 6/1975 | McCoy . | |
| 4,673,310 | 6/1987 | LeBaron | 404/26 |
| 4,906,128 | 3/1990 | Trudel . | |
| 5,044,818 | of/1991 | Pritchard . | |
| 5,211,504 | 5/1993 | Trudel . | |
| 5,308,189 | 5/1994 | Claing | 404/26 |

FOREIGN PATENT DOCUMENTS 2010948 of 1992 Canada .

*Primary Examiner*—William P. Neuder
*Attorney, Agent, or Firm*—ROBIC

[57] ABSTRACT

A raising band for use in a manhole, which is both waterproof and very easy and non-costly to construct, thus rendering it easily adjustable as the need arises whatever be the height of the layer of asphalt that is adds to the road surface. It includes an upper ring of metal dimensioned to receive the cover of the manhole and a lower ring, also of metal, dimensioned to be inserted into the recess provided for receiving the cover of the manhole frame. These two rings are joined by a cylindrical sleeve made of metal, which is welded to them all along the length of its upper and lower edges.

6 Claims, 2 Drawing Sheets

WATERTIGHT RAISING BAND FOR MANHOLE

BACKGROUND OF THE INVENTION a) Field of the Invention

The present invention relates to a raising band for use in a manhole provided with a cover, so as to lift this cover.

In the present disclosure as well as in the appended claims, reference will essentially be made to a "manhole", because it is the most advantageous application for a watertight raising band. However it will be understood that the latter may also be used in other structures; such as in a sewer opening.

b) Brief Description of the Prior Art

It is well known that the great majority of asphalt roads have manholes with covers. At the time of the addition of a new layer of asphalt on the road, it is necessary to adjust the level of the manhole frame. Instead of breaking the frame and manufacturing a new one, the usual practice is to utilize raising bands including an upper section and a lower section of different diameters which are molded in one piece. The upper section of such band has a shoulder designed to rest on the periphery of the frame of the manhole such that the cover is on a level equal to the level of the new layer of asphalt. Examples of this type of band are described in U.S. Pat. Nos. 2,431,082; 2,593,918 and 3,240,133.

Although these molded bands are efficient, they present the major drawback of not being adaptable to any desired height of the added layer of asphalt. In fact, as their height is not adjustable, it is necessary to adjust the layer of asphalt to them, which is undesirable. They have the further drawback of being expensive since they require a mold for their fabrication.

In an attempt to solve this problem, U.S. Pat. No. 5,044,818 discloses a molded raising band which, with the addition of a new layer of asphalt, can be raised, both at the level of it slower section by a first spacer, and also at the level of the shoulder of its upper section by a second spacer. This technique is clever but has the drawback of being non-versatile because the band is molded from one piece and is not adaptable by itself to the desired height of the layer of asphalt. In fact, the use of this raising band necessitates the use of two or more spacers if a height adjustment is required.

U.S. Pat. No. 3,891,337 discloses a raising band which includes a ring of metal on which rests the cover of the sever opening. The ring is dimensioned to be installed in an internal recess of the frame of the sewer opening and has a vertical skirt welded to its exterior periphery to contain the layer of asphalt added until flush with the road surface. The ring and the skirt are open in such manner as to allow a certain elasticity but no reinforcement is provided at the level of the upper extremity of the skirt, which is a source of problems since there is often warping due to the weight supported in use by the cover of the sewer opening.

Canadian Patent nos. 1,285,167 and 2,010,948 issued to the present Applicant, disclose raising bands of simple and efficient construction. These rings include an upper ring and a lower ring made of metal joined by fastening tongues welded either vertically with respect to the plane of the rings (the first mentioned Canadian Patent), or at an angle of inclination between 30 and 60 degrees (the second mentioned Canadian Patent). These rings are very simple, non-costly and very easy to construct by simple welding. As a feature of their construction, they are equally easily adaptable to the needs of the user because, whatever the height of the layer of asphalt added, the user can voluntarily adjust the height of the tongues. Yet this type of raising bands has the major drawback of not being waterproof. Indeed, running water can penetrate between the fastening tongues and infiltrate the asphalt or the structure of the frame of the manhole.

OBJECT OF THE INVENTION

The object of the present invention is essentially to provide a raising band which, on the one hand, is waterproof and, on the other hand, may be easily and inexpensively produced, thereby making it easily adaptable to the needs of the user regardless of the height of the added layer of asphalt.

This new raising band combines the advantages of the structures of molded raising bands, that are waterproof but not adjustable, with the advantages of the structure of raising bands having an upper ring and a lower ring joined together by welded tongues, the latter being non-costly, easily adjustable as need be but not waterproof. Thus, a good resistance to water and an adaptability to any height of the added layer of asphalt, are obtained by the raising band of the present invention.

SUMMARY OF THE INVENTION

Thus, the raising band which forms the object of the present invention, is devised to be both waterproof and also non-costly to construct and modify, thereby making it easily adjustable according to need whatever the height of the added layer of asphalt.

The raising band of the present invention is, like all raising bands of this type, intended to be used in a manhole provided with a cover of a given height, so as to raise the cover which has an upper face and a lower face of a given area. As is known, the manhole includes a frame having an upper surface in which is formed a recess which has a base parallel to the upper surface of the frame and a lateral face perpendicular to the upper surface. This recess has a surface slightly superior to that of the cover to receive and support the latter at a height substantially equal to that of the cover.

The raising band of the invention includes an upper ring, a lower ring and connecting means.

The lower ring of the raising band has an upper wall, a lower wall and internal and external lateral walls; the dimensions of the ring are such that its lower wall rests against the base of the recess of the frame of the manhole.

The upper ring of the raising band also has an upper wall, a lower wall and internal and external lateral walls, and is so dimensioned as to rest against the upper surface of the frame of the manhole. This ring is thus of larger diameter than that of the lower ring and defines an internal surface substantially equal to and of the same shape as the surface of the cover.

The connecting means of the raising band are designed to attach together the upper and lower rings. According to an essential characteristic of the invention, these means consist of a rigid, waterproof sleeve co-axially joining the upper and lower rings. This sleeve presents an upper extremity fixed in a continuous manner to the internal lateral wall of the upper ring and a lower extremity fixed to the external lateral wall of the lower ring. This double fixation is made at a selected height in such a way that, once the sleeve is attached to the upper and lower rings and the raising band is disposed in the recess formed in the manhole frame, i.e. when the lower wall of the upper ring rests on the upper surface of the frame and the lower wall of the lower ring rests on the base of the recess, the upper face of the cover is at the level of the upper wall of the upper ring.

As may be appreciated, the sleeve, due to its structure, renders the raising band waterproof. Moreover, the latter being made of three simple and interchangeable elements, it becomes possible to manufacture it to easily satisfy any demand as to a given height of asphalt since it is then sufficient to utilize a higher sleeve, which can be easily fabricated and assembled as a function of the need, without requiring a mold.

Preferably, the upper and lower rings and the sleeve are circular and cylindrical in shape, since such is generally the case for most manholes. This is however not essential and these elements could be rectangular or square if the frame of the manhole is rectangular or square.

Preferably also, the rings and the sleeve are metal and the sleeve is fixed to the rings by welding. The metal of the rings and the sleeve is preferably steel. This renders the whole very simple to make and assemble.

According to a particular embodiment of the invention, the manhole frame has at least one internal projection designed to fit into a corresponding peripheral notch formed in the cover in such manner as to prevent the rotation of the cover. In such case, the upper ring has at least one internal projection dimensioned and positioned to engage in each peripheral notch ill which one or several projections of the cover can be fitted.

According to another particular embodiment the invention, the upper and lower rings are each fabricated from a bar of metal folded back and welded by its extremities; the bar presents a cross-section of rectangular shape and the sleeve consisting of a plate of sheet metal folded back and welded. Thus, the raising band of the invention is completely waterproof thanks to the collar welded to the rings; it is also adaptable to any height of the new layer of asphalt added on due to the fact that it is very easy to weld the sleeve to any specific height.

The invention and its numerous advantages will be better understood upon reading of the following non-restrictive description of a preferred embodiment thereof, given with respect to the accompanying drawings, in which:

DETAILED DESCRIPTION OF A PREFERRED EMBODIMENT OF THE INVENTION

Figure 1:
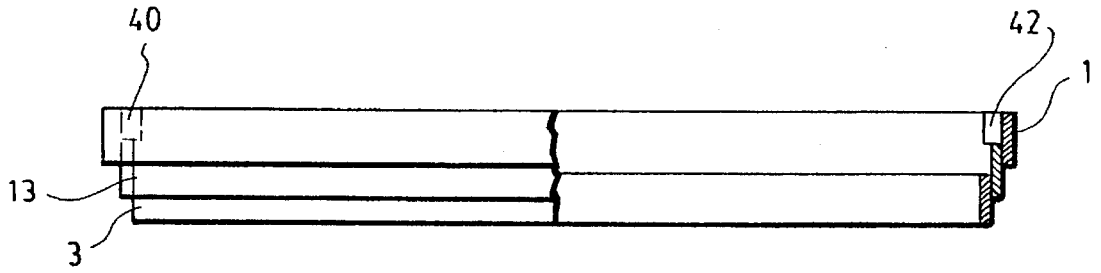
FIG. 1 is a side elevational view of a raising band according to a preferred embodiment of the invention.

The raising band "A", illustrated in the drawings is of circular shape and is designed to be utilized in a manhole 21 provided with a frame and a circular cover 32. However, the band "A" could be of another shape if the frame and the cover are also of different shape.

Figure 3:
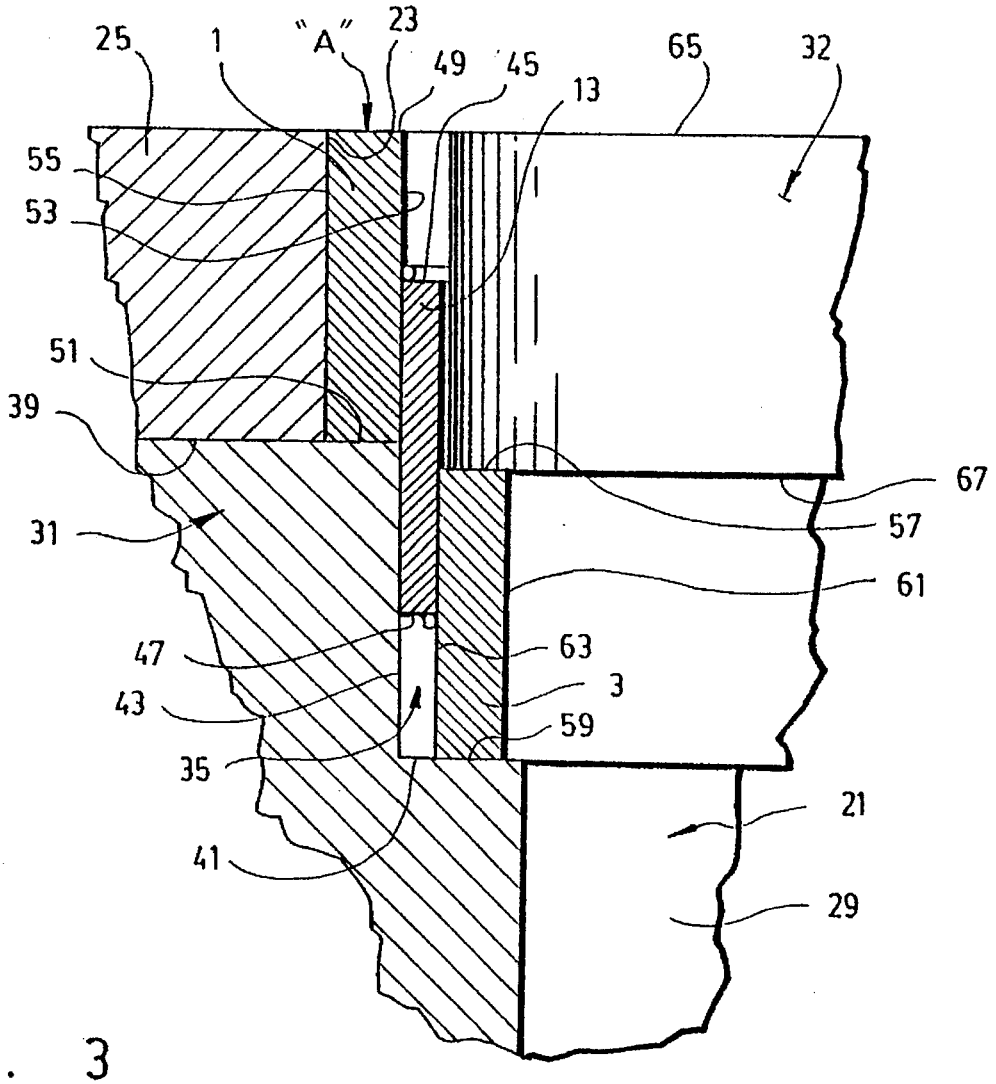
FIG. 3 is a cross-sectional view taken along lines 3—3 of FIG. 2.

More precisely, such as is best illustrated in FIG. 3, manhole 21 includes a conduit 29 communicating with the opening of the frame 31, which is made of concrete or cast iron and is devised to receive the cover 32. The frame 31 has an upper surface 39 in which is defined a recess 35 having a base 41 parallel to the upper surface 39, and a lateral face 43 perpendicular to this upper surface. The recess 35 has a surface area slightly greater than the surface of cover 32 to receive and support the latter. It also has a height approximately equal to that of the cover.

Figure 2:
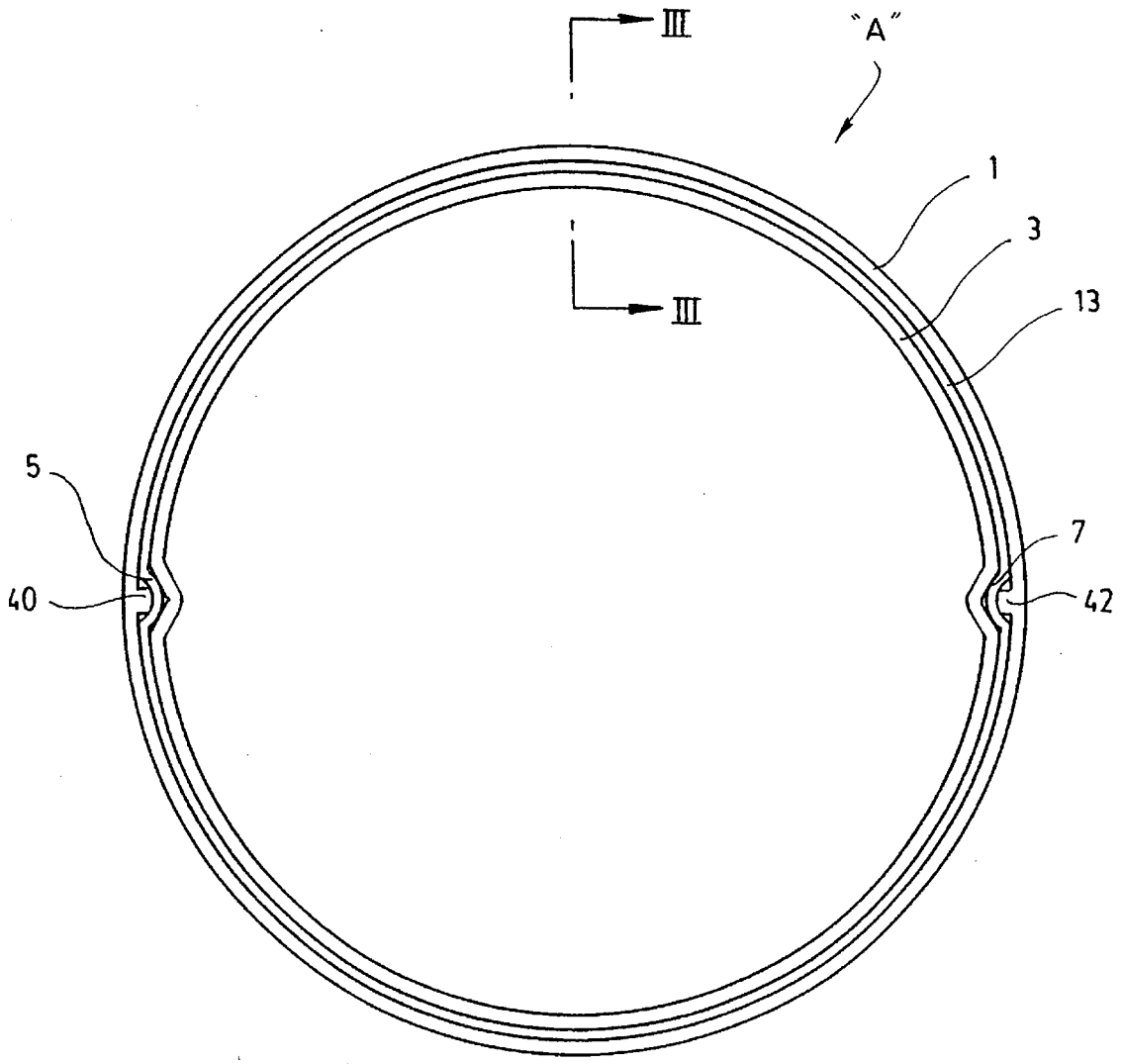
FIG. 2 is a top plan view of the raising band of FIG. 1.

As illustrated in FIGS. 1 and 2, the raising band "A" of the invention includes an upper ring 1 and a lower ring 3. Each of the rings 1 and 3 is fabricated from a steel bar, presenting a cross-section of rectangular shape. Each bar is folded back and welded at its extremities to form the corresponding ring, as is known. Each of the rings 1 and 3 has very specific internal and external diameters which will be discussed hereinbelow. Nevertheless, it may be mentioned immediately that the lower ring 3 presents an external diameter substantially identical to the internal diameter of the upper ring 1.

As better seen in FIG. 3, the lower ring 3 has an upper wall 57, a lower wall 59 and two lateral walls: internal wall 61 and external wall 63. The upper ring 1 has an upper wall 49, a lower wall 51, a lateral internal wall 53 and a lateral external wall 55.

The rings 1 and 3 are positioned in a co-axial manner and joined one to the other by connecting means constituted by a cylindrical sleeve 13 which is co-axial with the two rings. The sleeve 13 has an upper extremity 45 and a lower extremity 47, and is constituted of a plate of sheet metal folded back and welded. The sleeve 13 also has a diameter approximately equal to the external diameter of the lower ring 3 and to the internal diameter of the upper ring 1.

As is shown in FIG. 3, the upper extremity 45 of the sleeve 13 is welded to the internal lateral wall 53 of the upper ring 1 and its lower extremity 47 to the lateral external wall 63 of the lower ring 3 in such a way as to give a good water proofness to the raising band against the ambient humidity and running water.

The main object of the raising band "A" described above is to enable the raising band to be inserted in the recess 35 of the frame 31 in order to raise the cover 32 when this is desired. To achieve this, the lower ring 3 of the raising band has an external diameter chosen so that its lower wall 59 rests against the base 41 of the recess. The upper ring 1 of the raising band also has an external diameter chosen to rest against the upper surface of the frame. This upper ring 1 is thus necessarily larger than the lower ring 3 and has an internal diameter chosen so as to have an internal surface area approximately equal to, and of the same shape as, the interior face 67 of the cover 32. Finally, the sleeve is fixed to the upper and lower rings 1 and 3 in such a manner that, when the raising band "A" is disposed in the recess 35 provided in the manhole frame 31, i.e. when the lower wall 51 of the upper ring 1 rests on the upper surface 39 of the frame and the lower wall 59 of the lower ring 3 rests on the base 41 of recess 35, the upper face 65 of the cover 32 is at the same level as the upper wall 49 of the upper ring 1.

In other words, the recess defined by the internal lateral walls of the upper ring 1 and of the sleeve 13 and by the upper wall 57 of the lower ring 3, is dimensioned in such manner as to be approximately the same shape as the recess 35, with a view of being substituted for the latter to receive and support the cover 32.

In practice, the heights of rings 1 and 3 and of the annulus 13 must equally be chosen as a function of the thickness of the layer of asphalt 25 that it is desired to add to the road surface.

The fabrication of the raising band "A", being carried out as it is by simple welding of folded plates of metal, it will be understood that it is very easy for its manufacturer to meet the needs of the users, which relate to the thickness of the asphalt layer which the latter want to apply and to the height of the existing manhole cover.

In all cases, a good waterproofness is assured since the sleeve 13 and upper and lower rings 1 and 3, respectively, are of one piece and remain so regardless of the pressures and forces exerted by the cover 32 and the asphalt layer 25 on band "A". No leaking of running water or the like is therefore possible since the elements of the raising band "A", i.e. the two rings 1 and 3 and the sleeve 13, are maintained welded to each other.

Figure 4:
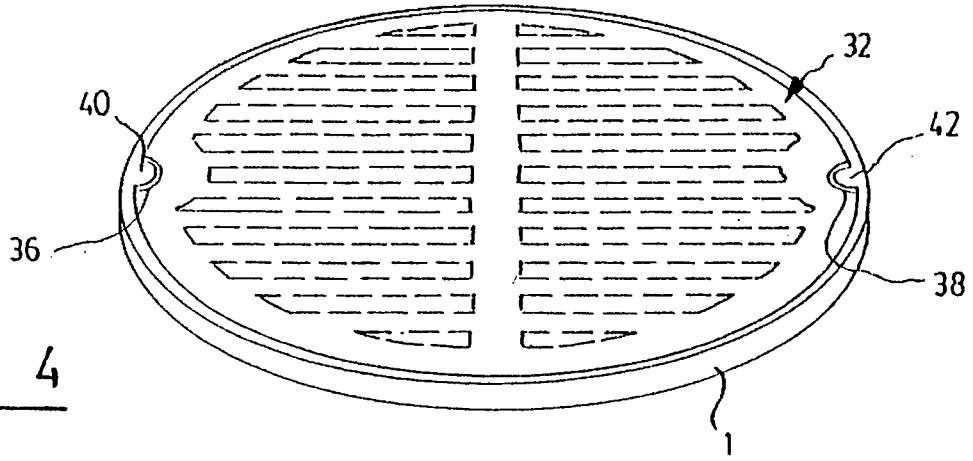
FIG. 4 is a perspective view of a manhole cover adapted to be received by the raising band of FIGS. 1 and 2.

When, as is often the case, frame 31 of the manhole presents internal projections (not illustrated) conceived to fit into corresponding peripheral notches 36, 38 provided in cover 32 in a manner to prevent a rotation of the latter, the upper ring 1 of the raising band "A" presents a similar set of internal projections 40, 42 dimensioned (see FIG. 4) and positioned to fit into peripheral notches 36, 38 of the cover. The lower ring 3 and, if need be, the sleeve 13 present in that case a set of notches 5, 7 similar to those of the cover into which the projections of the frame can fit.

Of course, numerous modifications could be made to the above-described embodiment without departing from the scope of the invention as it is defined in the appended claims.

The embodiments of the invention in which an exclusive property or privilege is claimed are defined as follows:

1. A raising band for use in a manhole having a cover of a given height to raise said cover, the latter having an upper face and a lower face of a given surface, said manhole comprising a frame having an upper surface in which is defined a recess having a base parallel to the upper surface of the frame and a lateral face perpendicular to the said upper surface, said recess having a surface area slightly greater than that of the cover to receive and support the latter and a height approximately equal to that of the said cover, said raising band comprising:

a lower ring having an upper wall, a lower wall and internal and external lateral walls, said lower ring being dimensioned so that its lower wall rests against the base of the recess;

an upper ring having an upper wall, a lower wall and internal and external lateral walls, said upper ring being dimensioned to rest against the upper surface of said frame, said upper ring being also larger than the lower ring and having a surface area approximately equal to and of the same shape as the surface of the cover; and connecting means to join together the said upper and lower rings; wherein said connecting means consists of a rigid and waterproof sleeve co-axially joining said lower and upper rings, said sleeve having an upper extremity fixed in a continuous manner on the internal lateral wall of the upper ring and a lower extremity fixed on the external lateral wall of the lower ring, said double fixation being carried out at a height chosen in such manner that, one said sleeve is fixed to said upper and lower rings and the raising band is disposed in the recess provided in the manhole frame, that is when the lower wall of the upper ring rests on the upper surface of the frame and the lower wall of the lower ring rests on the base of said recess, the upper face of the cover is at the level of the upper wall of the upper ring.

2. A raising band for use in a manhole provided with a circular cover of a given height to raise said cover, the latter having an upper face and a lower face of a given surface, said manhole comprising a circular frame having a surface in which is defined a circular recess presenting a base parallel to the upper surface of the frame and a lateral surface perpendicular to the upper surface, said circular recess having a surface area slightly greater than that of the cover to receive and support the latter and a height approximately equal to that of the cover, said band comprising:

a lower circular ring having an upper wall, a lower wall and internal and external lateral walls, said lower ring having a first diameter chosen so that its lower wall rests on the base of the recess;

an upper circular ring having a upper wall, a lower wall and internal and external lateral walls, said upper ring having a second diameter greater than that of the lower ring in such manner that the upper ring may rest on the upper surface of the frame, said upper ring also having an internal surface area approximately equal to the surface of the cover; and connecting means to join together said upper and lower rings, wherein said connecting means consists of a cylindrical, rigid waterproof sleeve co-axially joining the upper and lower rings, said sleeve having an internal diameter approximately equal to the first diameter of the lower ring and an external diameter approximately equal to the second diameter of the upper ring, said sleeve further having an upper extremity fixed in a continuous manner to the lateral internal wall of the upper ring and a lower extremity fixed to the lateral external wall of the lower ring, such double fixation being carried out at a chosen height in such manner that, once the sleeve is fixed to the upper and lower rings and the raising band is positioned in the recess provided in the manhole frame, that is when the lower wall of the upper ring rests on the upper surface of the frame and when the lower wall of the lower ring rests on the base of the recess, the upper face of the cover is at the level of the upper wall of the upper ring.

3. A raising band as defined in claim 2, wherein the upper and lower rings and the sleeve are made of metal and said sleeve is fixed to said rings by welding.

4. A raising band as defined in claim 3, wherein the metal of the rings and sleeve is steel.

5. A raising band as defined in claim 3, wherein the band is usable in a manhole having a frame presenting at least one internal projection designed to be fitted into a corresponding peripheral notch in the cover in a manner to prevent rotation of said cover, said upper ring having at least one internal projection dimensioned and positioned to fit into each peripheral notch of the cover, said lower ring having at least one notch in which one or more projections of the frame can fit.

6. A raising band as defined in claim 3, wherein the upper and lower rings are each fabricated from a bar of metal that is folded back and has extremities welded to each other, said bar having a rectangular cross-section, and the sleeve consists of a plate of sheet metal folded back and welded.

* * * * *